United States Patent [19]

Javaher

[11] Patent Number: 5,054,143

[45] Date of Patent: Oct. 8, 1991

[54] ANTI-WRINKLE PILLOW

[76] Inventor: Troy Javaher, 2325 Bolton Ct., Modesto, Calif. 95356

[21] Appl. No.: 408,661

[22] Filed: Sep. 18, 1989

[51] Int. Cl.[5] ..... A47G 9/00

[52] U.S. Cl. ..... 5/434; 5/437

[58] Field of Search ..... 5/437, 434, 436, 441, 5/435; D6/601, 604

[56] References Cited

U.S. PATENT DOCUMENTS

| | | | |
|---|---|---|---|
| D. 174,996 | 6/1955 | Peters | D6/601 |
| D. 303,897 | 10/1989 | Phillips | D6/601 |
| 2,961,668 | 11/1960 | Hayes | 5/434 |
| 3,327,330 | 6/1967 | McCullough | 5/437 |

OTHER PUBLICATIONS

"Pillow Sizes", an ad on p. 36 of the May 1988 issue of Waterbed Magazine.

*Primary Examiner*—Alexander Grosz
*Attorney, Agent, or Firm*—Frank Weyer

[57] ABSTRACT

The present invention is an "anti-wrinkle" pillow that surpasses the limitations of prior art designs by keeping the delicate facial skin completely away from contact with the pillow and its covering when a person sleeps on his or her side. Instead of manipulating pressure or height, the present invention incorporates a tubular "extension piece" which is placed snugly under the jawbone, thereby providing better support and comfort than prior art pillows and leaving the facial skin completely untouched.

2 Claims, 2 Drawing Sheets

ANTI-WRINKLE PILLOW

BACKGROUND OF THE INVENTION

Although most existing pillows provide certain degrees of both comfort and support, they unfortunately also press against the delicate and sensitive surface of facial skin, creating unsightly "morning-wrinkles" and creases "when a person, rather than sleeping on his or her back, sleeps on his or her side". Yet while there have been attempts to design pillows that would reduce this creasing and wrinkling of skin, all such prior art designs have had the following undesirable trait in common: the surface of the pillow, despite variations in the design of the pillow underneath, remains in direct contact with the facial skin. While such prior art pillows may reduce "morning-wrinkles" to some extent, such direct contact between the facial skin and the pillow surface exposes the facial skin to the pillow's covering, which, even in a clean environment, naturally accumulates unseen dirt and grime that is then in contact with the skin.

SUMMARY OF THE INVENTION

The present invention is an "anti-wrinkle" pillow that surpasses the limitations of prior art designs by keeping the delicate facial skin completely away from contact with the pillow and its covering "when a person sleeps on his or her side". Instead of manipulating pressure or height, as do prior art "anti-wrinkle" pillows, the present invention incorporates a tubular "extension piece" which is placed snugly under the jawbone, thereby providing better support and comfort than prior art pillows and leaving the facial skin completely untouched.

DETAILED DESCRIPTION OF THE INVENTION

Figure 1:
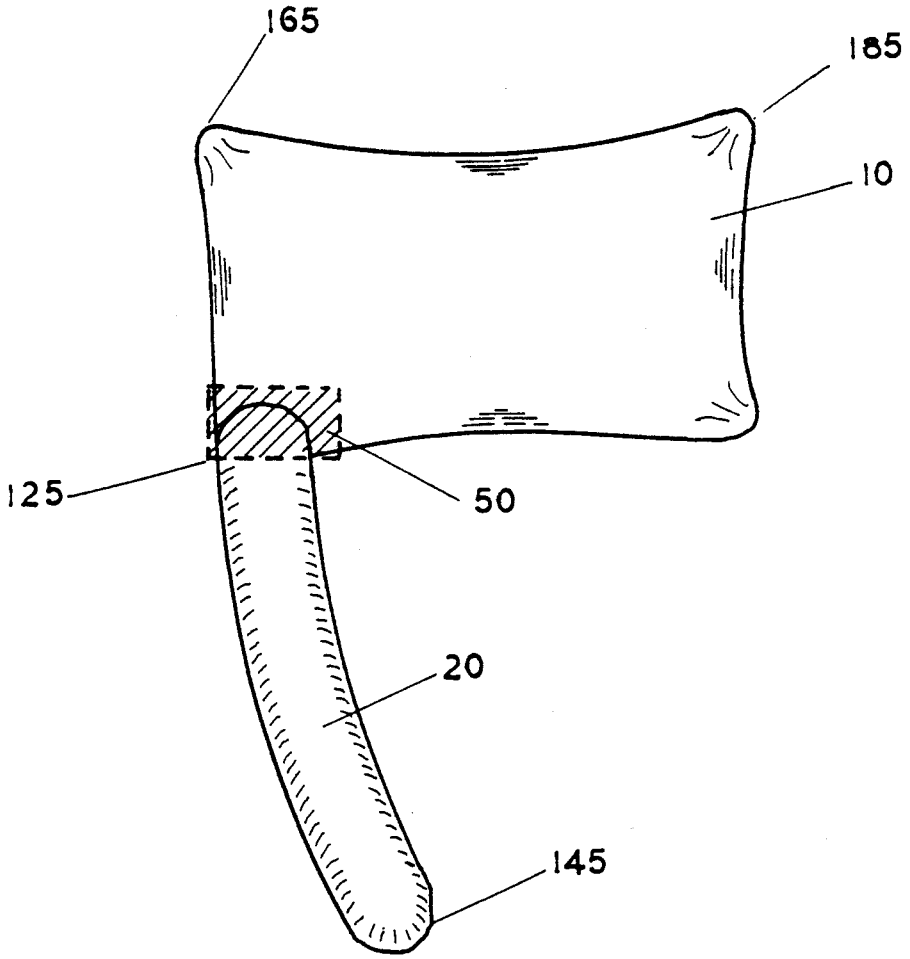
FIG. 1 is a top view of the preferred embodiment of the pillow of the present invention.
Figure 2:
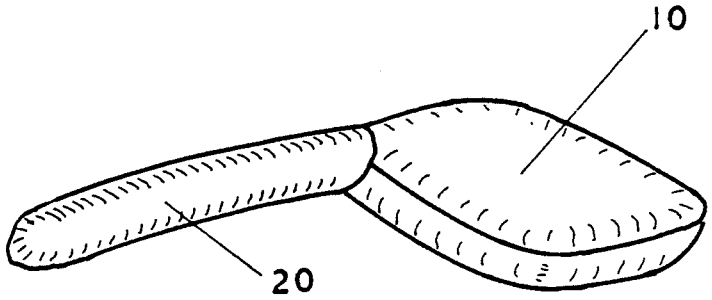
FIG. 2 is a side view of the preferred embodiment of the present invention.

FIGS. 1 and 2 show the preferred embodiment of the pillow of the present invention. As can be seen from FIG. 1, the present invention is comprised of two main components: main section 10 and extension piece 20. Main section 10 in the preferred embodiment resembles very much a conventional pillow, though it can have a variety of other shapes. Extension piece 20 is attached to and extends outwards from main section 10. In the preferred embodiment, extension piece 20 has a generally tubular shape with a circular or oval cross-section. However, extension piece 20 can be square, triangular, or have a variety of other cross-sectional shapes. Extension piece 20 may extend straight outwards from main section 10, may extend in a curve as in the preferred embodiment shown in FIG. 1, or may have a more complicated shape. Preferably, however, as shown in FIG. 2, the height or thickness of main section 10 is greater than that of extension piece 20. Preferably, the length of extension piece 20, that is from point 125 to point 145 in FIG. 1, is approximately equal to the length of main section 10 when measured from point 165 to 185. However, the length of extension piece 20 can be longer or shorter without affecting the beneficial characteristics of the present invention. As shown in FIG. 1, the extension piece 20 is preferrably attached adjacent to one of the corners of main section 10. However, extension piece 20 may be attached to main section 10 at any other desired location.

The pillow of the present invention can be made of various materials, including conventional pillow-making materials, with the only restriction being that extension piece 20 be made so that it retains its tubular shape and firmness, yet remains pliable.

Figure 3:
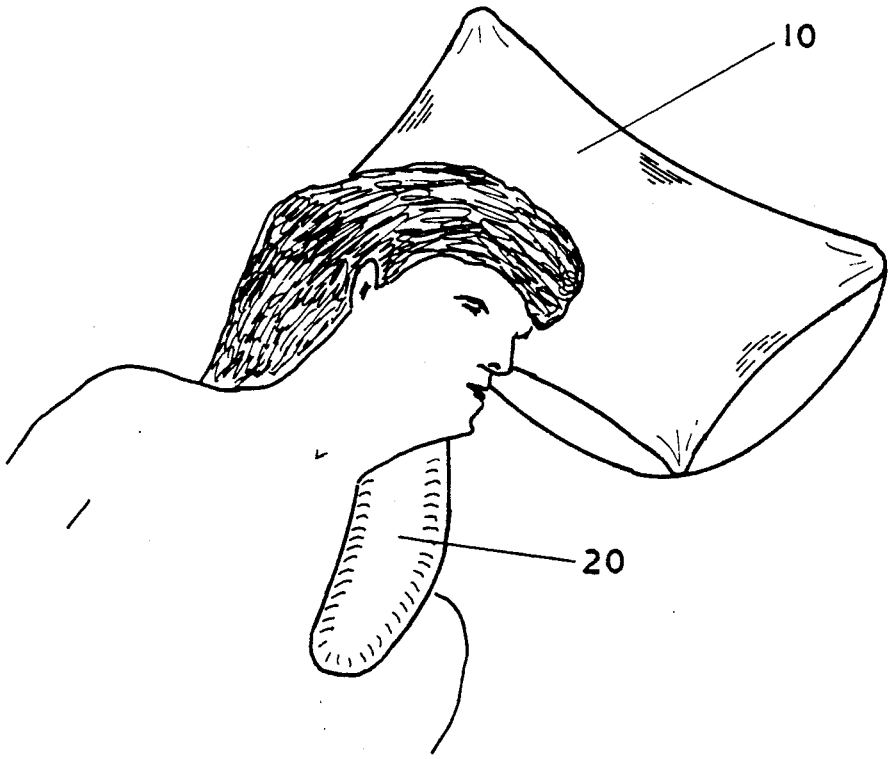
FIG. 3 is a side view of the preferred embodiment of the present invention showing how it is used in practice.

As illustrated in FIG. 3, the present invention achieves its aims as follows. As the individual using the pillow lays on his or her side, the upper part of the head, that is the area above the ears and eyebrows, rests upon main section 10. Next, with contact area 50 (indicated by cross-hatching in FIG. 1) positioned behind the upper neck area, extension piece 20 is placed snugly under the individual's jawbone and on top of the individual's shoulder. With extension piece 20 placed thusly, in between the shoulder and the jawbone, the facial areas will not be in contact with the pillow's surface, and accordingly will not be subjected to the undesirable pressure, abrasiveness, and naturally occuring dirt and grime of the pillow surface. The combination of the height of main section 10 and the individual's shoulder nicely places the head and neck areas into the desired position for sleeping.

The present invention overcomes an additional problem of prior art pillows. With respect to prior art pillows designed to prevent creasing of facial areas, the present invention is far less likely to be used in an inappropriate manner. Even though an individual using a prior art pillow may place the pillow in the correct position to avoid wrinkling before falling asleep, since prior art designs depend upon correctly positioned cradle areas or "valleys" adjacent to which the face must be maintained in order for the pillow to function properly, prior art pillows can very easily lose their efficiency if the user moves his or her head up or down during sleep. The present invention, however, is much less affected by this type of movement since the support provided by extension piece 20 comfortably restricts downward movement of the head. Once in position, therefore, the present invention not only maintains the proper sleeping posture of the head and neck, but also ensures that the facial skin is free from any unnecessary contact.

Other configurations of the present invention will be apparent to those skilled in the art.

I claim:

1. A pillow comprising:

a main section means having a generally rectangular planar shape with a length in a first direction, a width in a second direction perpendicular to the first direction, a thickness in a direction orthogonal to the first and second directions, and at least one corner; and a substantially resilient, generally longitudinal extension means having a substantially tubular cross-section with a diameter substantially fixedly attached to the main section means adjacent to the corner of the main section means at a junction such that the extension means extends outwards away from the main section means generally in the direction of the second direction for a distance from the junction approximately equal to the length of the main means, the thickness of the main section means being greater than the diameter of the extension means, the main section means and the extension means comprising contact surface means at and immediately adjacent to the junction, the contact surface means being capable of supporting a person's head and neck when the person is sleeping on his or her side.

2. The pillow of claim 1 wherein the extension means extends outwards away from the junction in a slight arc.

* * * * *